United States Patent [19]

Gulliksen et al.

[11] 4,225,906

[45] Sep. 30, 1980

[54] LUMINAIRE APPARATUS WITH MULTIPLE LIGHT SOURCES AND METHODS OF OPERATING SAME

[75] Inventors: John E. Gulliksen, Shrewsbury; Roy A. Guimond, Holden, both of Mass.

[73] Assignee: Koehler Manufacturing Company, Marlborough, Mass.

[21] Appl. No.: 886,783

[22] Filed: Mar. 16, 1978

[51] Int. Cl.[3] ..... F21V 19/04

[52] U.S. Cl. ..... 362/254; 362/106; 362/164; 362/184; 362/238; 362/240; 362/241

[58] Field of Search ..... 362/105, 106, 164, 184, 362/206, 227, 233, 237, 238, 239, 240, 241, 254

[56] References Cited

U.S. PATENT DOCUMENTS

| | | | |
|---|---|---|---|
| 1,184,400 | 5/1916 | Wilson | 362/254 |
| 1,757,887 | 5/1930 | Wheat | 362/106 |
| 1,845,399 | 2/1932 | Chominger | 362/254 |
| 2,024,897 | 12/1935 | Wade | 362/254 |
| 2,079,732 | 5/1937 | Conley | 362/254 |
| 2,123,435 | 7/1938 | Ceill et al. | 362/254 |
| 3,529,146 | 9/1970 | Betlejewski et al. | 362/254 |
| 3,529,147 | 9/1970 | Badalich | 362/254 |
| 4,092,704 | 5/1978 | Maln | 362/106 |

*Primary Examiner*—Howard A. Birmiel

[57] ABSTRACT

A luminaire housing body is formed with a reflector chamber closed at one side by a radiation transmitting member. At an opposite side, the housing is extended to form a socket enclosure. A lamp socket member is rotatably mounted in the socket enclosure and is structured to define spaced apart inwardly dished reflector surfaces, hereinafter referred to as concaved reflective surfaces, in each of which a lamp may be placed at a focal point and independently energized by electrical means. A reflector member is located in back of the radiation transmitting member and is formed with a socket aperture.

At either side of the concaved reflector surfaces, the socket member is shaped to present tapered outer ends which can be moved into and out of the socket aperture. The arrangement of the parts is such that a de-energized lamp is constantly shielded by the tapered ends to prevent shadow or distortion when another lamp is in use. The socket member is rotated by means of a socket locking spindle which when removed, allows for lamp socket replacement, if desired.

When the luminaire apparatus is utilized as a portable unit, the lamps are energized by a battery also carried by the user. Each lamp is independently operable by switch control means in the socket enclosure. When provided with an attaching hook, the housing in a relatively small size may be attached to a cap member to constitute a headpiece. Such a headpiece is particularly suited for use with a miner's cap lamp apparatus wherein the rotary socket means may support dual lamps to provide a miner with effective back-up light sources.

13 Claims, 25 Drawing Figures

Fig. 1
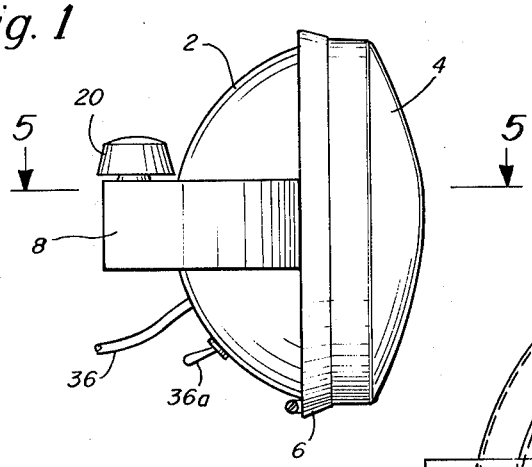
Fig. 2
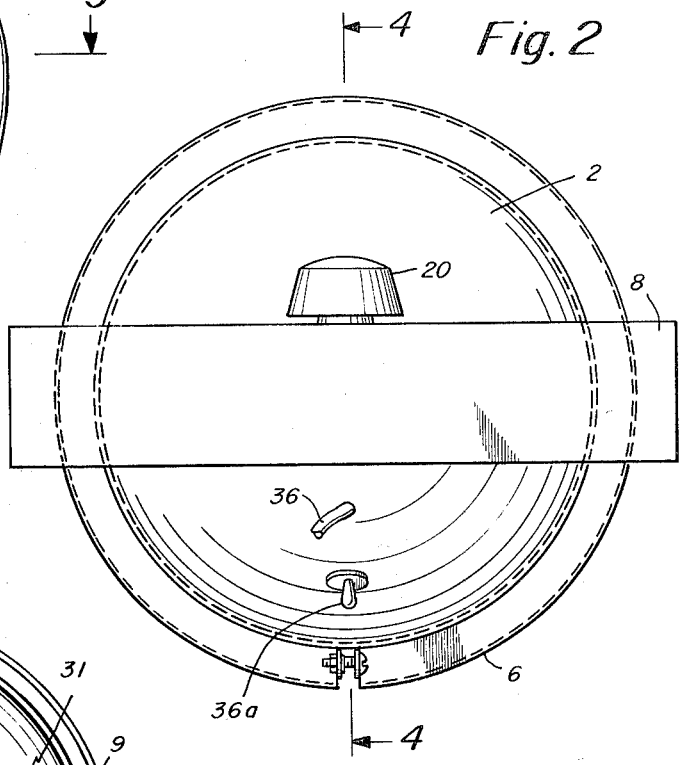
Fig. 3
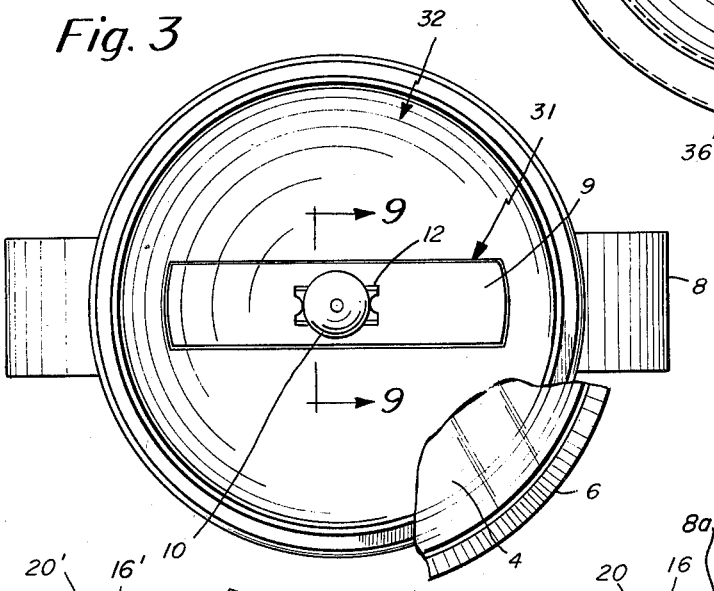
Fig. 4
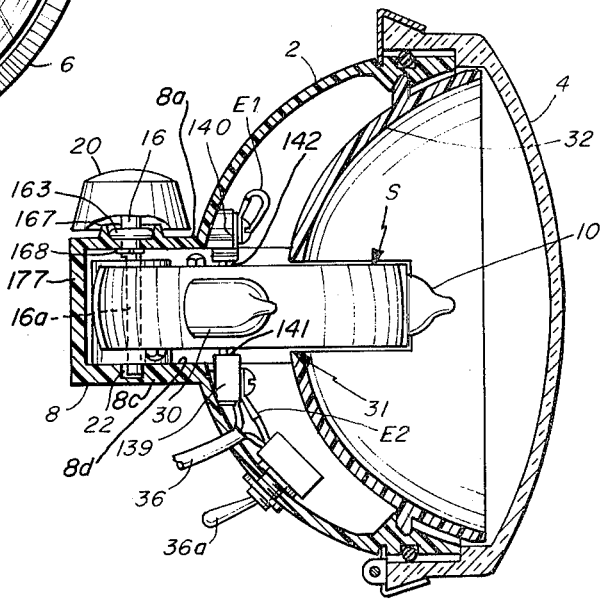
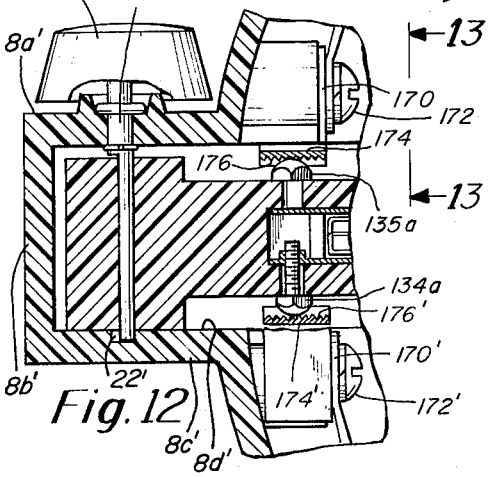
Fig. 12

Fig. 6
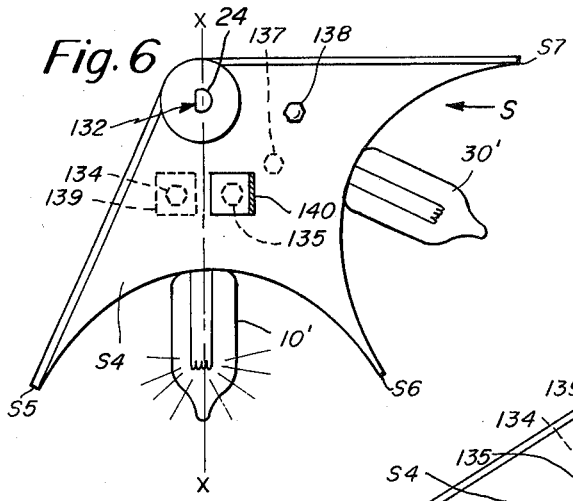
Fig. 7
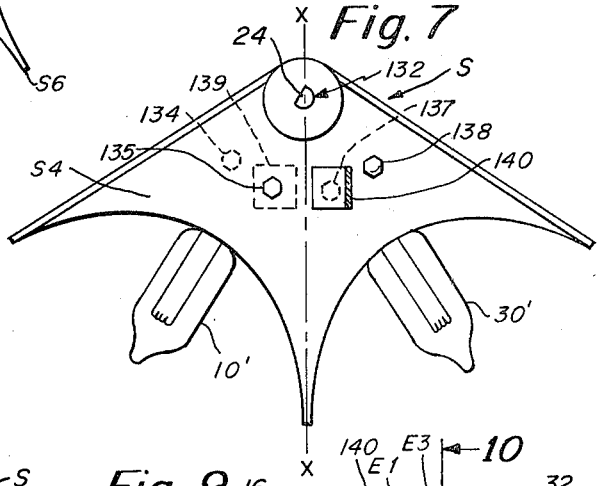
Fig. 8
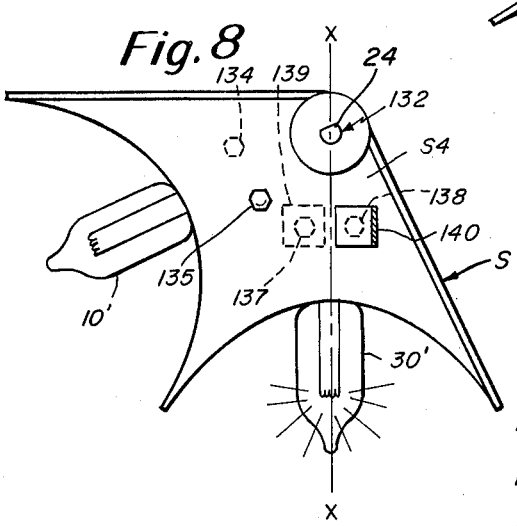
Fig. 9
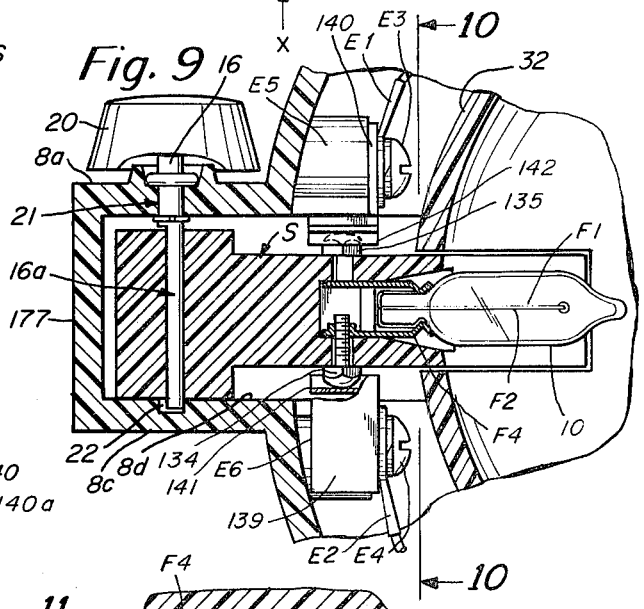
Fig.10
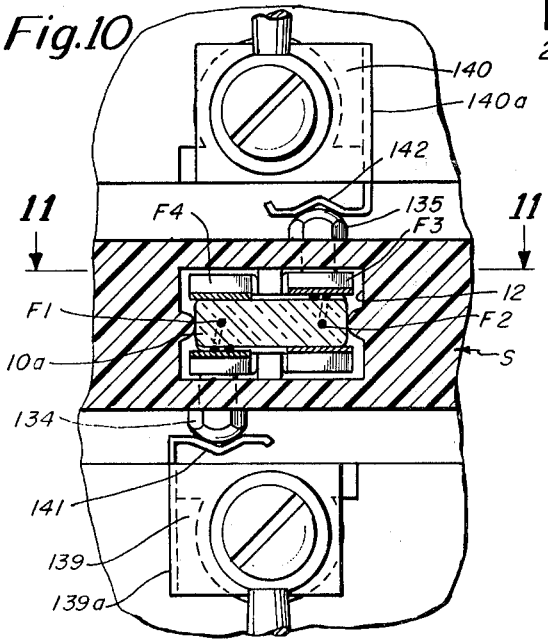
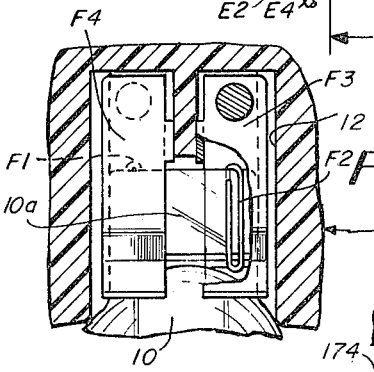
Fig.11
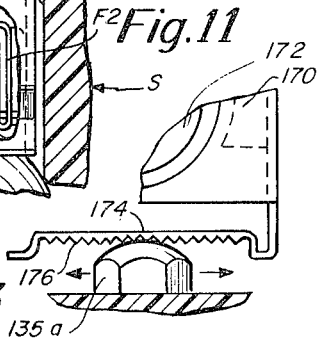
Fig.13

Fig. 22
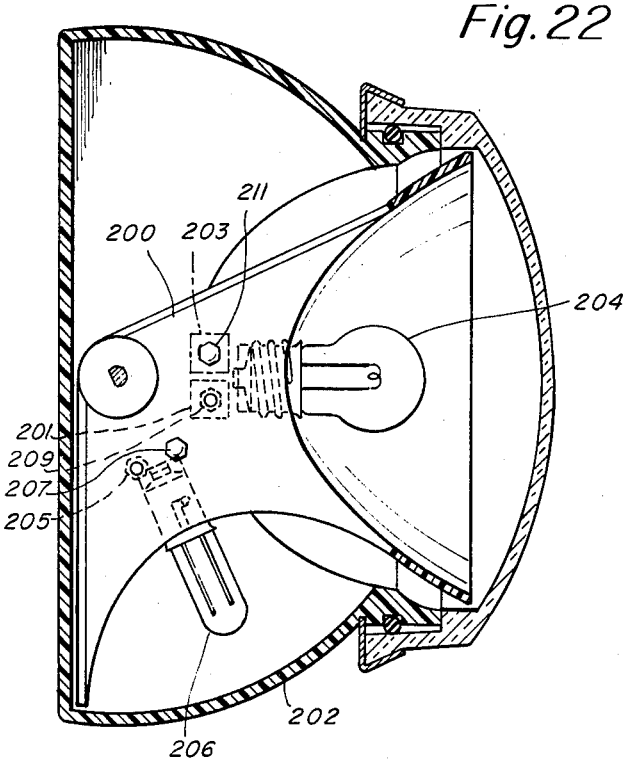
Fig. 23
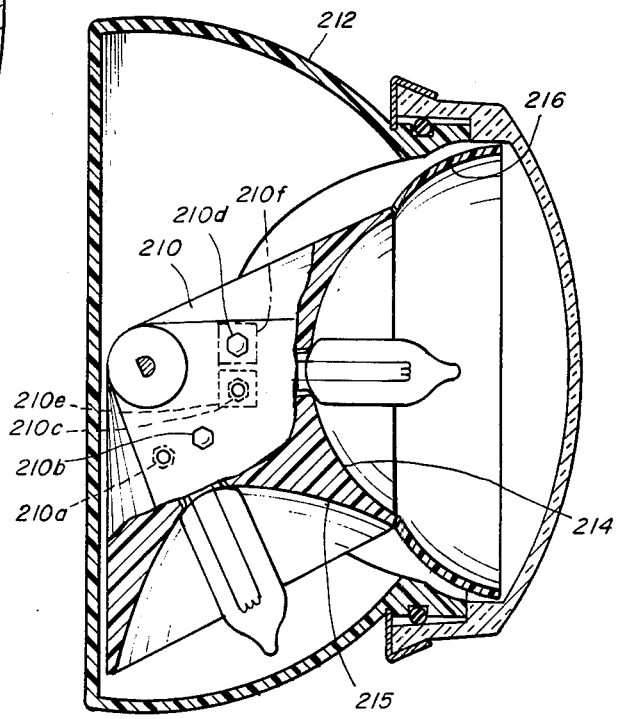
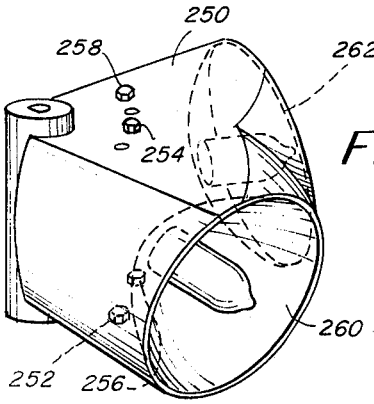
Fig. 24
Fig. 25
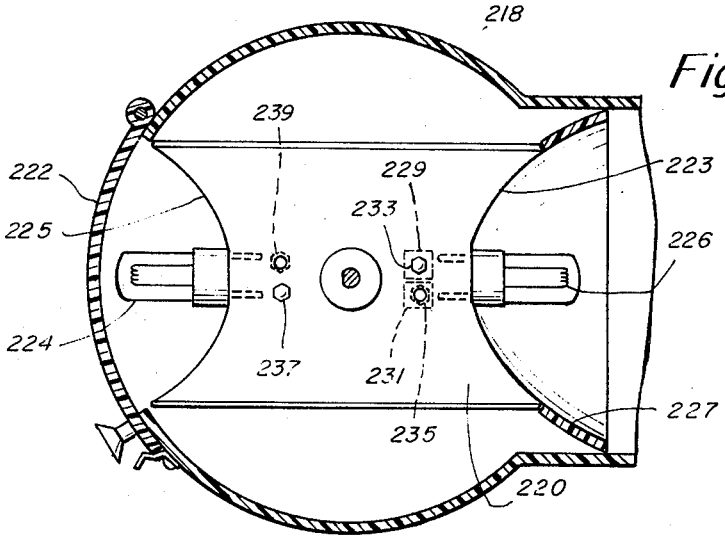

LUMINAIRE APPARATUS WITH MULTIPLE LIGHT SOURCES AND METHODS OF OPERATING SAME

BACKGROUND OF THE INVENTION

In the use of conventional luminaire apparatus, there are many instances where lamp failure may become a problem. This has led to various proposals for providing a back-up or auxiliary source of light which can be utilized to replace a faulty lamp quickly and effectively. This is especially true in connection with cap lamp apparatus where a headpiece is attached to the cap of a user. A particular case in point is the headpiece customarily worn by a miner under ground where it is highly important from the standpoint of miner safety that the back-up light be capable of projecting reflected radiation without distortion, shadows or other objectionable lighting patterns.

Various proposals have been made in the art to provide an auxiliary or back-up light source. One approach has been to utilize two bulbs located adjacent to one another in a reflector chamber. Devices of this type are disclosed for example in U.S. Pat. Nos. 1,361,557; 1,757,888; 2,623,158; 2,794,114. Means are also combined with two bulbs in some of these devices for preventing explosive gases being ignited by an incandescent filament.

These patented devices have been found to be objectionable in operation for various reasons. It has not been possible to place the back-up light anywhere near the focal point of the reflector system. Therefore, the resulting light distribution pattern must necessarily be grossly distorted. Also with any of the various lamp arrangements described, a lamp means which is not being used will cast shadows and produce distortions of an objectionable nature.

Another approach to providing a back-up light source has been to furnish a plurality of light sources any one of which may be moved into an operative position in various classes of luminaire apparatus. U.S. Pat. No. 1,830,537 discloses a motion picture projection apparatus having a dual lamp source rotatably mounted in the frame of the projection apparatus. U.S. Pat. No. 2,054,013 discloses a flashing light signal device in which a plurality of lamps are mounted for rotary movement in a carrier body. U.S. Pat. No. 2,032,515 discloses an automobile headlight in which are supported a plurality of lamp elements mounted for reciprocating movement in a spring loaded holder and rotatable to selectively engage through an orifice in a headlight reflector.

SUMMARY OF THE INVENTION

The present invention relates generally to luminaire apparatus which may be utilized to provide either a stationary or a portable source of light. The invention, although not limited thereto, is especially concerned with cap lamp apparatus of the class which can be attached to a cap member or "hard hat". Such a cap lamp means is commonly referred to as a headpiece and is worn by various workers such as is exemplified by a miner.

It is a chief object of the invention to improve luminaire apparatus and to devise reflector bodies in which lamp socket structures may be rotatably received to support a plurality of lamp elements whose number may be suited to a task at hand. It is also an object to provide a rotatable socket structure for containing lamps any one of which may be placed at any desirable point within and along the central axis of the reflector body to provide a back-up light source which is more efficient and more easily operated than available prior art devices of this class.

Another object of the invention is to provide a plurality of light sources, each of which may have substantially identical light patterns and minimal distortion; also a plurality of light sources of differing levels of illumination; also light sources which may have differing light emission patterns.

A further object of the invention is to combine with a luminaire housing body socket means which may be replaceably mounted in the housing body and which may provide for interchangeability of socket and lamp units.

To these ends, there have been devised socket structures which may occur in several different forms and which have spaced apart sockets for supporting a plurality of lamps. There have further been provided luminaire housing bodies constructed with socket enclosure means in which multiple socket structures may be mounted for rotation through desired arcs of rotation. Switch control means may be combined with the socket structures to provide for manually placing any one of the lamps and its supporting socket in an operative position.

An important feature of the switch control means is the provision of unique contact elements secured within the socket enclosure above and below the socket body, and arranged to selectively engage the contact elements are contact buttons mounted in the socket body in positions such that any lamp may be alternately energized and all of the lamps may be positioned in an off state.

The housing bodies are further characterized by the inclusion of parts, portions of which may be spaced apart to define socket openings in which the rotatable socket structures may be received. The socket structures are characterized by reflector parts movable therewith. These reflector parts may be shaped to mate with a respective socket openings when one of the lamps is placed in an operative position. In such a location, the reflector parts complement the spaced apart reflector surfaces. By means of this arrangement, it becomes possible to place one lamp member at the focal point of the reflector chamber with other lamp means being shielded. In this way, distortion of a light distribution pattern is completely eliminated.

BRIEF DESCRIPTION OF THE DRAWINGS

FIG. 1 is a side elevational view of a luminaire body having rotatable socket means of the invention supported herein together with a rotor knob located externally of the luminaire body.

FIG. 2 is a rear elevational view of the structure shown in FIG. 1.

FIG. 3 is a front elevational view of the same structure with a radiation transmitting member removed.

FIG. 4 is a cross section taken on the line 4—4 of FIG. 2 and showing a socket member in elevation together with electrical contact elements secured inside the luminaire body above and below the socket member.

FIGS. 6, 7 and 8 are sequence views of a rotary socket similar to that of FIG. 5 arranged in three positions of rotary adjustment.

FIG. 9 is a cross section taken on the line 9—9 of FIG. 3 showing the contact elements of FIG. 4 on a somewhat larger scale and also illustrating electrical contact buttons mounted in the socket for engagement with the contact element.

FIG. 10 is a cross section taken on the line 10—10 of FIG. 9 showing details of the electrical connection of a pin type bulb with respective contact buttons and contact elements of the type illustrated in FIGS. 4 and 5.

FIG. 11 is a cross section taken on the line 11—11 of FIG. 10.

FIG. 12 is a detail view showing a modified detent arrangement for use with contact buttons.

FIG. 13 is a fragmentary prospective view of the detent arrangement of FIG. 12 shown on a larger scale.

FIG. 22 is a plan view illustrating socket means for containing two different types of lamp elements which may be used in the invention.

FIG. 23 is a plan view of a rotatable socket having a fixed reflector body and in addition inwardly dished reflector surfaces on the socket body which are not necessarily extensions of the surface of rotation of the fixed reflector body and are full surfaces of rotation.

FIG. 24 is a modified socket structure illustrating the fact that said socket structure may include reflector surfaces which are full surfaces of rotation and are not necessarily identical to one another.

FIG. 25 is a plan view of another dual socket and luminaire structure in which means are provided so that a spent bulb may be replaced from a rear side of the luminaire structure without need for de-energizing the other bulb.

DETAILED DESCRIPTION OF THE INVENTION

Figure 5:
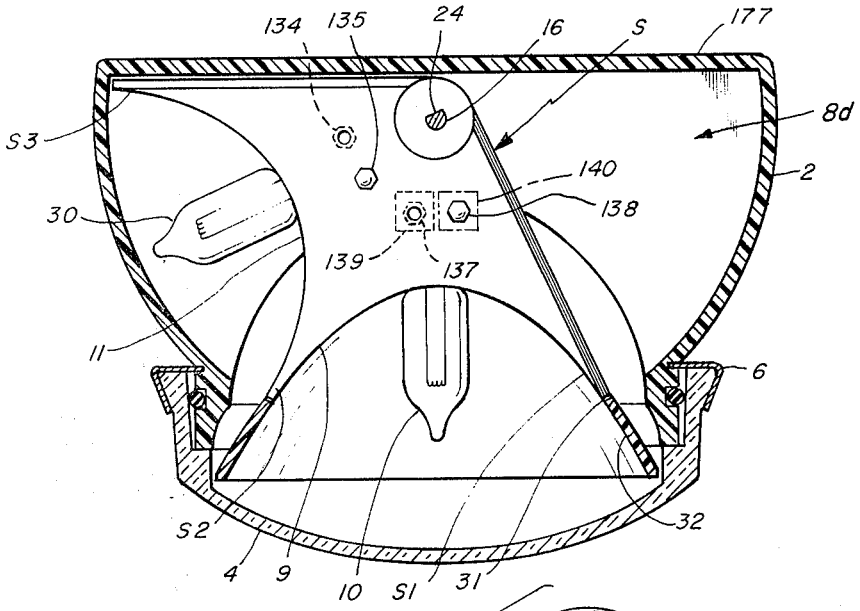
FIG. 5 is a plan cross section taken approximately on the line 5—5 of FIG. 1 to show further details of the socket assembly of FIG. 4 and indicating in dotted lines one of the electrical contact elements of FIG. 4 occurring below the socket member and the second contact element of FIG. 4 in phantom above the socket member.

In general, the luminaire apparatus of the invention comprises an optical system in which a plurality of lamp and socket units are constructed and arranged for rotation in a unique manner. Each of the lamps may be located along the central axis of the reflector system perhaps at a focal point of the system and structural portions of the rotatable socket are so shaped that when rotation occurs outer extremities of the socket will always extend along an arc of rotation corresponding at least to the arc of rotation of a lamp member which is de-energized. Shielding conditions are thus created by means of which all of the lamps may function satisfactorily in the system, but no shadow or distortion from a de-energized lamp is projected from the luminaire body and the size and character of the lamps may be varied in a number of ways as desired.

Principal parts of the optical system include a housing body formed with a reflector chamber which may be closed at one side by a radiation transmitting member. A rear side of the housing is extended to provide a socket enclosure in which a socket body may be rotatably supported together with a plurality of lamps. A reflector body located in front of the socket enclosure is formed with a socket aperture into and out of which the rotatable socket and a supported lamp may be moved when desired. Movement of the socket may be to selectively position a bulb in an operative position or, when the radiation transmitting member is removed from the housing 2 as hereinafter discussed in the specification in reference to FIG. 17, to provide for replacing the socket assembly with another socket unit. A source of electrical power such as a battery or an AC outlet may be employed and a master switch is provided to control all circuits in the system. As earlier noted, the rotatable socket body carries contact buttons which are selectively engageable with contact elements fixed in the socket enclosure to energize each lamp selectively while de-energizing all others and which may be used to de-energize all lamps simultaneously.

Referring more in detail to the drawings, FIGS. 1–5 illustrate one form of luminaire body which may be utilized in the invention. The housing body 2 as shown is closed at one side by a radiation transmitting member 4 secured by means of a bezel ring 6. An opposite side of the housing body is extended to provide a lamp socket enclosure 8 which also is illustrated in FIGS. 2 and 4. The enclosure 8 is formed with a top wall 8*a*, a rear wall 8*b* and a bottom wall 8*c*. The bottom wall 8*c* is further formed with a guide surface 8*a* more clearly shown in FIGS. 4 and 9. The wall 8 is formed with a hole 21 and wall 8 is formed with a hole 22 as is also shown in FIG. 9.

Rotatably supported in the socket enclosure 8 is a lamp socket member generally denoted by the letter "S" and most clearly shown in FIGS. 3, 4 and 5. In accordance with the invention, the lamp socket member is structured to define spaced apart concaved reflector surfaces in which lamps, as 10 and 30, may be located at focal points or at any other points along the central axis of the system and independently energized by electrical means as hereinafter described.

The lamps 10 and 30, as they appear in FIGS. 1–19, may in a preferred form consist of a tungsten-halide bulb of the class having a wedge type base through which filaments are extended and secured by contact clips in a folded over position as will be described in detail. However, the use of other types of bulbs such as screw-type base bulbs, pin type base bulbs, fluorescent bulbs, carbon arc lamps and the like may be used.

In combination with the socket structure S is a reflector member 32 located rearwardly of the member 4 as suggested in FIG. 4 and formed with a hole to comprise a socket aperture 31 which is best shown in FIGS. 3 and 4. The socket aperture 31 is constructed so that portions of the rotatable socket together with a supported lamp therein may be moved into and out of the socket aperture when desired. In FIG. 3, the concaved reflector surface 9 of the socket S together with the lamp 10 is shown positioned in the socket aperture 31 in a typical operating position.

As may also be observed from an inspection of FIG. 5, the rotatable socket is shaped to present tapered outer ends S1, S2 and S3 which can be fitted into the socket aperture and which are so arranged that when rotation occurs, outer extremities of these tapered ends will extend along an arc of rotation of a magnitude corresponding at least to that of the arc of rotation of the extremity of either of the lamps 10 and 30 about the central axis of rotation of spindle 16. As earlier noted, this socket construction provides an important shielding function so that no shadow or distortion from a de-energized lamp is projected from the luminaire body.

Rotation of the dual socket member S may be carried out in any desired manner such as by means of the manually operable rotor knob 20 and socket locking spindle 16. A rear wall section 177 of the socket enclosure as shown in FIG. 5 functions as a positive stop preventing over rotation of the socket member S. The socket locking spindle 16 is constructed with a key portion having a flat side 16*a* extending throughout a lower portion of its length to mate with D-shaped hole 24 in the lamp socket member S as shown in FIGS. 4 and 5. An O-ring seal member 163 is provided around the spindle above an upper wall portion of socket enclosure 8. Immediately below the upper wall portion is a snap ring retainer 168 which fits into a groove in spindle 16. Rotor knob 20 is preferably moulded onto the end of spindle 16. The upper or top wall 8*a* of the socket enclosure 8 as noted above, is formed with a hole 21 and the bottom wall 8*c* is formed with a hole 22. These are aligned with one another and serve to locate the spindle in a position of register with the D-shaped hole 24 of socket member S when this socket member is located on the guide surface 8*d*. It will be noted that a portion of the upper side of the socket enclosure surrounding the upper spindle hole is raised in the form of a ring 167. A recess may be provided in the knob 20 to accept this raised portion 167. This prevents any water or other liquid which may collect on the upper outer surface of enclosure 8 from having direct access to and running into the upper spindle hole.

Assembly of the parts described is accomplished by first adding the O-ring seal to the spindle; then inserting the socket assembly S into the enclosure body along the guide surface 8*d* to locate opening 24 in register with holes 21 and 22; then inserting spindle 16 through the upper side of the socket enclosure and down into the lower wall 22 in the socket enclosure with the flattened side of the spindle mating with the D-shaped hole in the socket body. Snap ring retainer 168 is engaged with the spindle.

In utilizing the knob and spindle 16, there are three basic positions of interest. In FIGS. 6, 7 and 8, a dual socket assembly similar to that of FIG. 5 is shown rotated about a point indicated by arrow 132 through the three basic positions of adjustment. These positions of adjustment may be conveniently related to the central axis of the reflector system of FIG. 4 denoted by the broken line X—X. In FIG. 6, socket S4 has its bulb 10' lying along this central axis in a position to be energized. In this FIG. 6, contact members 139 and 140 are in physical contact with contact buttons 134 and 135 respectively which, in fact, are engaged with detent portions 141 and 142 of the contact members 139 and 140 respectively. The contact elements and contact buttons are also shown in FIG. 4 and the detent portions 141 and 142 are further shown in FIG. 10.

FIG. 7 illustrates the dual socket assembly of FIG. 6 again in combination with the contact members 139 and 140, but with the dual socket assembly shown in that position of rotation about point 132 in which neither bulb member is energized, i.e., the luminaire is in an Off state. It will be noted also that neither bulb member 10' nor 30' is located along central axis X—X of the reflector system.

FIG. 8 illustrates the same dual socket assembly and contact member combination but with dual socket S4 in that position of rotation about point 132 such that bulb 30' is energized. Here, contact members 139 and 140 are in contact with contact buttons 137 and 138 respectively and, in fact, engaged with detent portions 141 and 142 of contact member 139 and 140 respectively. It will be noted also that here bulb member 30' is in a position lying along the central axis X—X of the reflector system.

It will be understood that the rotative socket structure may be utilized with various types of luminaire bodies including one with a reflector shape such as 32 shown or, if desired, with a reflector shape of any other concaved form. It is also pointed out that the concaved reflector surfaces 9 and 11 may be of corresponding shapes and may be of specular or non-specular reflectivity. In addition, the portion of the reflector surfaces, such as, for example, that of reflector surface 9, may be shaped so as to coincide with the edges of the enclosure aperture 31 in a mating relationship therewith; thus, no loss in reflectivity will be experienced where this is essential to operation of the luminaire body.

FIGS. 9, 10, and 11 are views showing in more detail the contact members 139 and 140 as well as other electrical components required for positioning retaining and energizing bulbs of the socket structure S. Electrical conductors E1 and E2 in cable 36 controlled by a master switch 36*a* are led into the housing 2 as suggested in FIG. 1, and are further illustrated in FIG. 9 and provide a source of power. The conductors are secured by screws as E3 and E4. These screws extend through the contact members 140 and 139 respectively and are threaded into boss portions E5 and E6 on inner sides of the housing 2. It will be observed that these contact elements 140 and 139 are formed with vertical wall sections through which the screws E3 and E4 extend and each of the wall sections having perpendicularly disposed wall portions 140*a* and 139*a* and lower edges of these wall portions 140*a* and 139*a* are turned inwardly to form the detent parts 141 and 142 earlier noted and best shown in FIG. 10.

As specified above, the lamps 10 and 30 may preferably be tungsten Halide bulbs of the pin type base and, as illustrated in FIGS. 9–12, bulb 10 has filaments F1 and F2 received through holes in the base 10*a* of the bulb 10. Extremities of the filaments are reversely folded around the exterior of the base 10 as indicated in FIGS. 10 and 11 and are resiliently engaged by a contact clip located in a space provided rearwardly of bulb base as shown. Contact buttons 135 and 134 are threaded into the socket and also into respective threaded bosses in the contact clips F3 and F4, as indicated in FIG. 9. It will be understood that socket S is formed to receive similar contact clips secured by contact buttons 137 and 138 for energizing bulb 30.

In rotating the socket body S utilizing detent structures such as detent portions 141 and 142, it has been found that a provision of relatively smaller detents may provide for precisely adjusting the filament location to produce sharper radiation effects. Thus, in FIGS. 12 and 13, there are illustrated contact members 170 and 170' similar to the contacts 139 and 140 and secured by screws 172 and 172', but having lower edge portions 174 and 174' turned in and formed with a series of small indentations 176 and 176' in which contact buttons 134*a* and 135*a* may engage when turned by knob 20'. By means of these small indentations, rotative movement may be carried out in small increments which makes it possible to find a point of adjustment where sharpest focusing may be realized and held.

Figure 14:
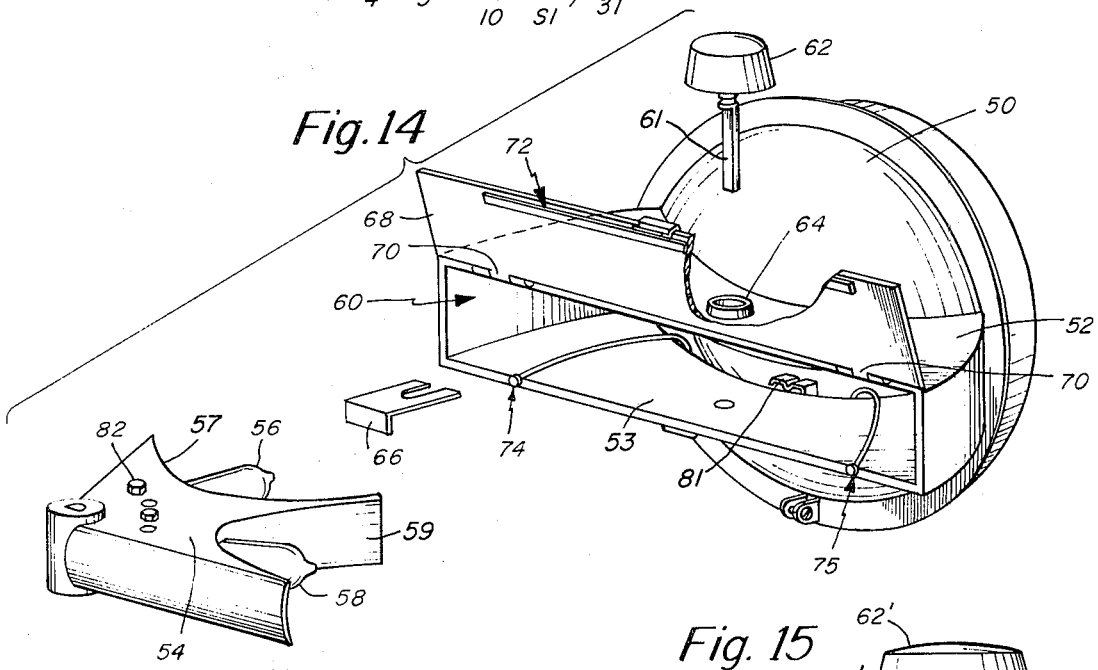
FIG. 14 is an exploded view illustrating in prospective a modified form of housing body provided with an access door and a socket member removed through the door and a protective door interlock operated by the door.

As stated above, replacing a socket is an important feature of the invention and it may be desired to utilize different modes of replacing a socket member. One such modification has been illustrated in FIG. 14 wherein a housing body 50 formed with a reflector chamber having a reflector element mounted therein in the manner earlier disclosed. The housing 50 is further formed with a socket enclosure 52 in which may be secured the socket member 54 supporting lamps 56 and 58 and reflector portions 57 and 59. The socket enclosure 52 is also formed with a guide surface 53 along which socket member 54 may be moved to position to register with the spindle 62. Electrical contacts as 82 arranged at upper and lower sides of the socket enclosure as suggested in FIG. 14 are engageable with contact elements as 81 located at upper and lower portions of the housing in the manner earlier described. In this arrangement, the rear side of the socket enclosure 52 is open to provide a doorway indicated by the arrow 60. Through the doorway, the socket may be readily installed and secured by a knob and spindle member 62 passed through an opening 64 and detachably held in place by means of a clip member 66. The doorway may be closed by a door member 68 hinged at points 70 and provided with an electrical contact element 72 for engagement with contacts 73 and 74. Opening the door de-energizes the optical system completely as is better illustrated in the diagrammatic wiring in FIG. 16.

Figure 15:
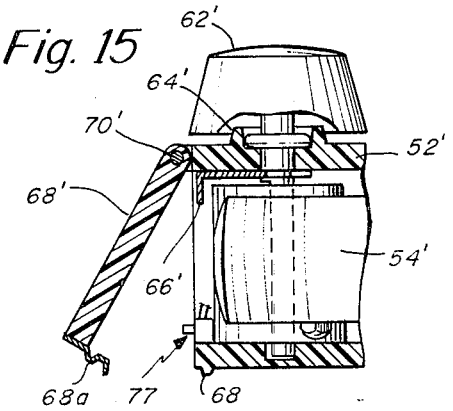
FIG. 15 is a detailed view further illustrating a housing structure similar to that of FIG. 14 and also illustrating an alternative form of the protective electrical door interlock.
Figure 16:
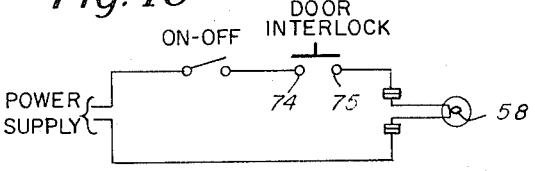
FIG. 16 is a diagrammatic view showing an electrical door interlock circuit.

In FIG. 15, there is illustrated a rear door arrangement for socket removal including a socket enclosure 54' in which a socket member 54' is secured by knob and spindle 62' in a socket enclosure 52'. A door 68' hinged at 70' is provided with a bottom clip 68*a* for engaging over a rib 69 on the bottom of the enclosure 52'. When the door 68' is closed, it places normally open contacts of pushbutton 77 in a closed or energized state.

Figure 17:
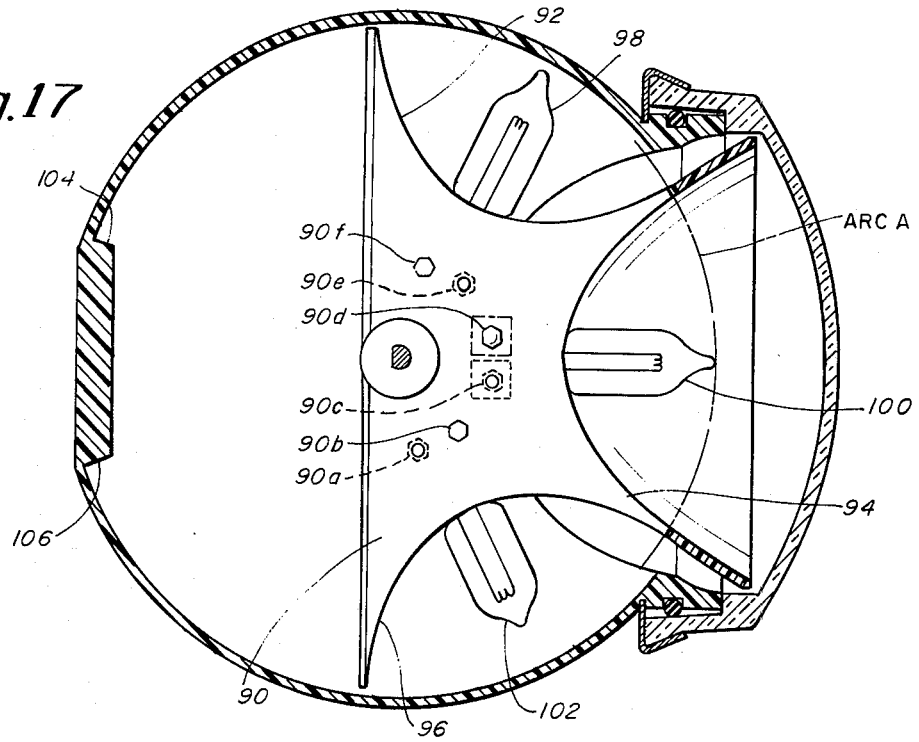
FIG. 17 is a view similar to FIG. 5 but showing a rotary socket member constructed with three socket and reflector components in which three lamp elements are received.

It has also been found that the use of a socket rotatably mounted in a socket enclosure may be desirably employed to support additional bulb members. For example, in FIG. 17, the socket 90 is structured to provide concaved surfaces 92, 94 and 96, in which may be supported bulbs 98, 100 and 102. In this arrangement of parts, the socket structure is made so that it will be engageable with stop surfaces 104 and 106 as indicated in FIG. 17. Contact members 90*a*, 90*b*, 90*c*, 90*d*, 90*e* and 90*f* may also be utilized as shown in the manner earlier described.

Figure 18:
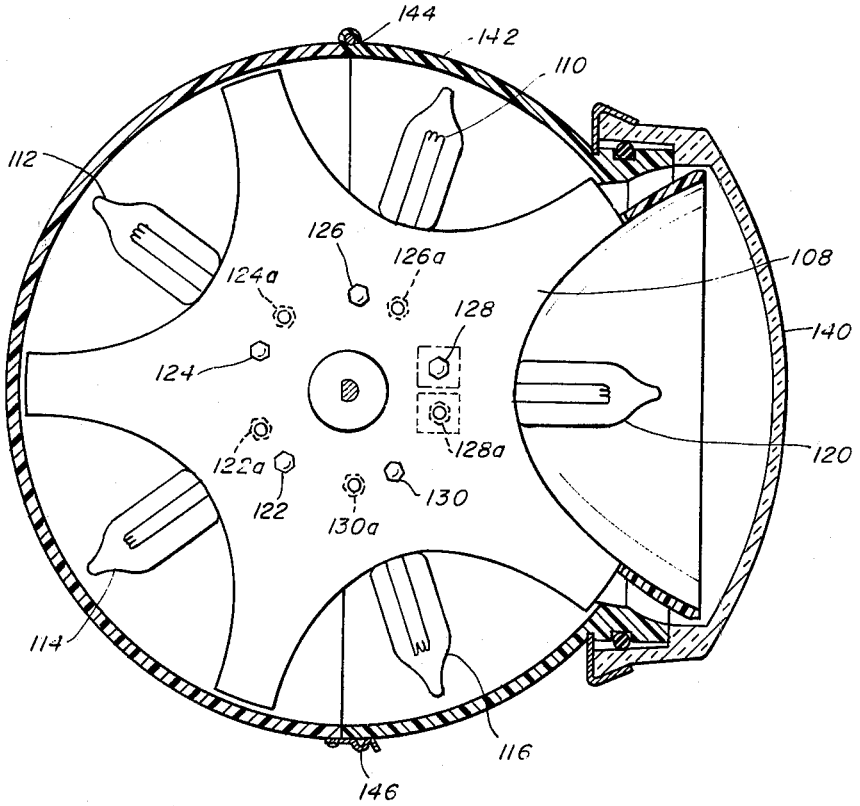
FIG. 18 is a view similar to FIG. 17 but constructed with five socket and reflector components for supporting five lamp elements.

An even greater number of bulbs may be utilized as indicated in FIG. 18. Socket structure 108 supports bulbs 110, 112, 114, 116 and 120, it being understood that these bulbs are connected to suitable electrical contacts as shown at 122, 122*a*, 124, 124*a*, 126, 126*a*, 128, 128*a*, 130, and 130*a* in FIG. 18.

The five bulb arrangement illustrated in FIG. 18 requires a socket shape as shown at 108 which cannot be removed from the housing body when the radiation transmitting member 140 is removed. This is unlike FIG. 17 where the three bulb socket can be withdrawn when the radiation transmitting member is detached. To deal with this problem as shown in FIG. 18, the housing body 142 is split into two parts which may be hinged at 144 and secured at an opposite side by a clip member 146. When the two parts are opened, socket removal is readily carried out.

Figure 19:
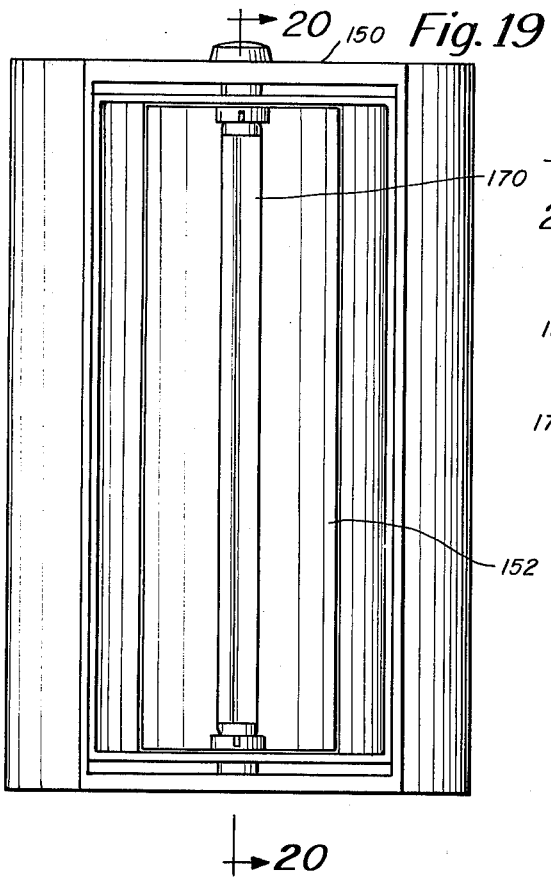
FIGS. 19, 20 and 21 are views illustrating rotatable socket means for supporting a pair of fluorescent bulb members.
Figure 20:
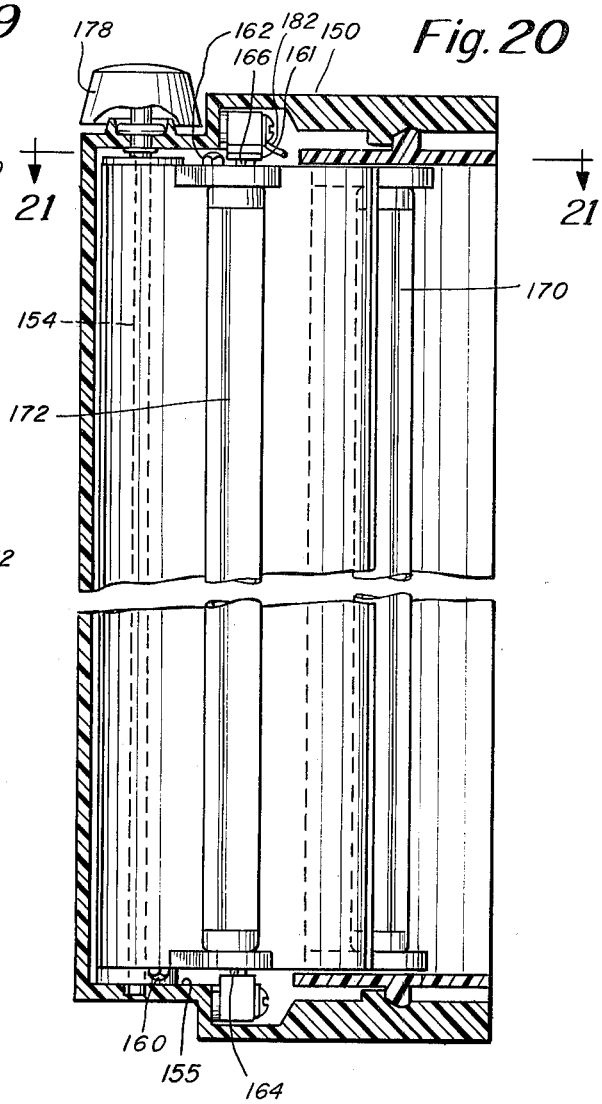
Figure 21:
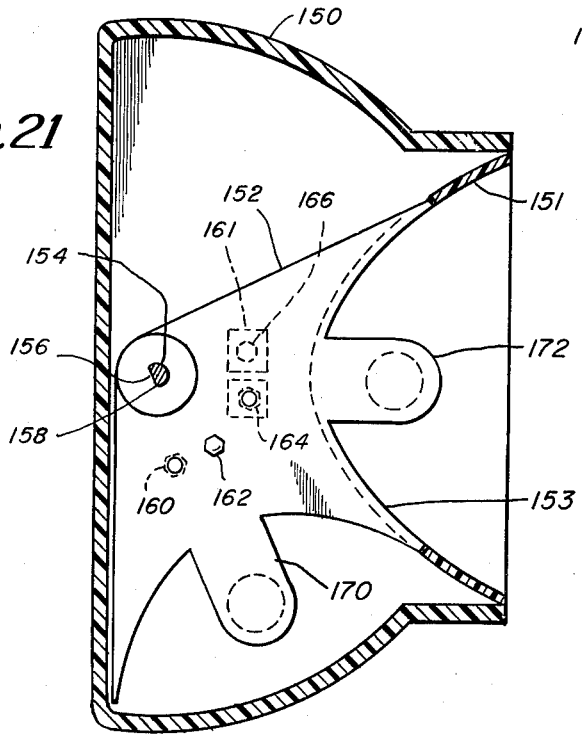

As stated earlier, the rotary socket means of the invention may also be utilized with other types of bulbs such as, for example, fluorescent bulbs as illustrated in FIGS. 19, 20, and 21. As noted therein, a fluorescent housing body 150 formed with a guide surface 155, has mounted therein against the guide surface 155 a socket member 152 which is rotatably secured by a spindle 154 having a knob 178. This spindle number corresponds to the spindles earlier described being formed with a flat side 156 slideably fitted into a D-shaped opening 158. The housing 150 is formed with a reflector chamber having a reflector element 151 and the socket member 152 is formed with reflector means as 153 arranged at either side of the bulbs 170 and 172.

Electrical contact means 161 is selectively engageable by contact buttons as 160, 162, 164 and 166 to provide for energizing either of the fluorescent bulb members 170 and 172. A source of electrical power may be provided at 182 in the manner earlier described.

Still other modifications in socket and lamp assemblies may be utilized such as the arrangements illustrated in FIGS. 22, 23, 24 and 25. For example, in FIG. 22, a socket element 200 mounted in a housing body 202 in the same manner earlier described may be used to support two different type of bulbs including the incandescent bulb 204 having a screw base and an arc lamp 206. Desirable changes in lighting effects may be achieved with this arrangement. Electrical contact elements 201 and 203 are engageable by contact buttons as 205, 207, 209 and 211.

In FIG. 23, another modification is shown in which a rotary socket 210 is combined with a housing 212 and is formed with a concaved lamp reflector part 214 having a shape as shown in that figure which merges with an outer reflector surface 216 of a different surface of rotation, also a reflector surface 215 which has yet another surface of rotation is shown. The socket 210 has mounted therein contact buttons 210*a*–210*d* which are engageable with contacts 210*e* and 210*f*. Interesting light changes may also be derived from this construction.

It is pointed out that reflector surfaces contained within a socket body do not necessarily have to be extensions of a fixed reflector body provided that these reflective surfaces that are a part of the socket structure are complete surfaces or rotation. Such an arrangement is illustrated in FIG. 24 in which a socket member 250 is made of a relatively greater thickness than socket previously discussed. The socket is constructed with concaved reflector surfaces 260 and 262 which are complete surfaces of rotation. These surfaces to not have to be identical but rather may describe entirely different contours from one another.

In some applications such as film projection and the like, it may be necessary to replace a spent bulb with a fresh one at the same time that the auxiliary bulb is operational in order to provide a continuing backup light source. FIG. 25 illustrates such a system in which rear door 222 in a housing 218 may be opened to provide ready access to a bulb 224 while bulb 226 is energized and fully operational. Socket 220 is of a shape to provide concaved surfaces 223 and 225 which can mate with reflector surfaces 227 in the manner already described. Contact members 229 and 231 are engaged with contact buttons 233 and 235. At an opposite side of the socket are contact buttons 237 and 239.

Various other changes and modifications in socket structure may be resorted to and in all of these forms of socket structure herein disclosed, the surface texture of these reflective surfaces may also be independently varied in such a manner that the distribution of light issuing from the system may be varied by simply rotating the spindle.

We claim:

1. Luminaire apparatus including a housing formed at a front side thereof with a reflector chamber having a reflector element mounted therein, a central section of the reflector element being removed to provide spaced apart edges which define an opening having a central axis coinciding with the central axis of the housing, said housing including a rearwardly disposed portion constructed with a lamp socket enclosure, said lamp socket enclosure being formed at one side thereof with guide surface means, a multiple lamp socket body mounted in the lamp socket enclosure for movement on said guide surface means, the multiple lamp socket body presenting a plurality of spaced apart lamp sockets, respective lamps and arcuate reflector portions occurring at either side of the lamps, said arcuate reflector portions being complementary to the said reflector element, said lamp socket body having electrical contact buttons extending outwardly from opposite sides thereof and being electrically connected to respective sockets, a plurality of inwardly extending electrical contact elements supported in the housing between the reflector opening and the lamp socket enclosure, said contact elements occurring in spaced apart relationship at either side of the central axis of the housing, means for supplying an electrical current to the contact elements, a retractable knob and spindle means rotatably mounted in the lamp socket enclosure and displaceably keyed to the lamp socket body for moving the contact buttons into and out of engagement with the contact elements to selectively energize said lamps.

2. The invention of claim 1 in which the lamp socket body, lamps and contact buttons are movable as a replaceable unit along the said guide surface means into a position of register with the spindle means when in a retracted position.

3. The invention of either claim 1 or 2 in which the lamp socket body, lamps and contact buttons are movable through the opening in the reflector member into sliding engagement with the said guide surface means.

4. The invention of either claim 1 or 2 in which the rearwardly disposed portion of the housing is formed with access means and the lamp socket, lamps and contact buttons are movable through the access means into sliding engagement with the said guide surface means.

5. The invention of claim 1 in which the means for supplying electrical current consists of an electrical cable passing through the housing and further includes a control switch connected to the cable.

6. The invention of claim 1 in which the socket body is formed with a D-shaped hole and the retractable spindle is constructed with a cylindrical part and a depending D-shaped key part, said cylindrical part being engageable against the top of the socket body when the D-shaped key portion is received through the D-shaped hole in the socket body.

7. The invention of either claim 1, 2 or 3 in which the lamps are incandescent bulbs.

8. The invention of either claim 1, 2 or 3 in which the lamps are tungsten halide bulbs.

9. The invention of either claim 1, 2 or 3 in which the lamps are fluorescent bulbs.

10. The invention of either claim 1, 2 or 3 in which the lamps are tungsten halide bulbs and said socket body is provided with contacts which are engageable with base terminals of a bulb, and said contacts having extremities of the said contact buttons engaged therewith to secure the contacts in fixed relation to the socket body.

11. The invention of either claim 1, 2 or 3 in which the contact elements are formed with indentations in which each of the contact buttons may be selectively positioned to energize a lamp and to provide for relatively fine radial focus adjustment of reflected radiation emitted from the energized lamp.

12. The invention of either claim 1, 2 or 3 in which the contact elements are formed with right angularly shaped extremities whose surfaces are formed with indentations, each of said contact buttons being adjustable along the indentations to energize a respective lamp to provide radial focus of reflected radiation emitted from the energized lamp.

13. The invention of either claim 1, 2 or 3 in which the contact buttons occur in pairs and each pair is arranged in predetermined, spaced apart relation, and each pair when moved through limited arcs of travel with the socket body engage the contact elements and selectively energize each of the lamps, and said pairs of contact buttons being further operable to move away from the contact elements and become held in a position to provide for no lamp being energized.

* * * * *